US011381034B2

(12) United States Patent
Kondo

(10) Patent No.: US 11,381,034 B2
(45) Date of Patent: Jul. 5, 2022

(54) CONNECTOR FITTING BODY

(71) Applicant: Sumitomo Wiring Systems, Ltd., Mie (JP)

(72) Inventor: Tomoyuki Kondo, Mie (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 8 days.

(21) Appl. No.: 16/963,288

(22) PCT Filed: Feb. 5, 2019

(86) PCT No.: PCT/JP2019/004017
§ 371 (c)(1),
(2) Date: Jul. 20, 2020

(87) PCT Pub. No.: WO2019/156061
PCT Pub. Date: Aug. 15, 2019

(65) Prior Publication Data

US 2021/0367377 A1 Nov. 25, 2021

(30) Foreign Application Priority Data

Feb. 8, 2018 (JP) ..... JP2018-021111

(51) Int. Cl.
*H01R 13/627* (2006.01)
*H01R 13/621* (2006.01)
(Continued)

(52) U.S. Cl.
CPC ..... *H01R 13/6215* (2013.01); *H01R 13/5202* (2013.01); *H01R 13/6315* (2013.01)

(58) Field of Classification Search
CPC ..... H01R 13/6315; H01R 13/6215; H01R 13/5202; H01R 23/4006; F16B 31/02; F16B 31/028; H01L 423/4006
(Continued)

(56) References Cited

U.S. PATENT DOCUMENTS 2,991,440 A * 7/1961 Kulka ..... H01R 12/58 239/17
3,636,502 A * 1/1972 Wallace ..... H01R 4/027 439/626
(Continued)

FOREIGN PATENT DOCUMENTS

JP 2-59584 5/1990
JP 2005-226692 8/2005
(Continued)

OTHER PUBLICATIONS

International Search Report dated Apr. 9, 2019.

*Primary Examiner* — Thanh Tam T Le
(74) *Attorney, Agent, or Firm* — Gerald E. Hespos; Michael J. Porco

(57) ABSTRACT

A connector fitting body (1) has a first housing (2) holding first terminals (21), a second housing (3) holding second terminals (31) to be conductive with the first terminals (21), a nut (5) arranged in a nut arrangement hole (32) in the second housing (3), and a bolt (4) arranged in a bolt arrangement hole (22) in the first housing (2) and engaged threadedly with the nut (5). A head (41) of the bolt (4) includes a large-diameter portion (411) serving as a first step for pressing the first housing (2) toward the second housing (3). The nut (5) includes a general portion (51) serving as a second step for pressing the second housing (3) toward the first housing (2). An end surface of the head (41) is in contact with an end surface of the nut (5).

7 Claims, 13 Drawing Sheets

(51) Int. Cl.
*H01R 13/52* (2006.01)
*H01R 13/631* (2006.01)

(58) Field of Classification Search
USPC ..... 439/247–248, 359, 362, 364, 485; 411/8–12
See application file for complete search history.

(56) References Cited

U.S. PATENT DOCUMENTS 3,853,381 A * 12/1974 Morningstar ..... H01R 13/6215 439/364
4,483,575 A * 11/1984 Kruger ..... H01R 13/4534 439/102
4,595,248 A * 6/1986 Brown ..... H01R 12/75 439/721
5,266,047 A * 11/1993 Black ..... H01R 13/631 439/364
5,295,856 A * 3/1994 Endo ..... H01R 13/6215 439/364
5,480,322 A * 1/1996 Ishii ..... H01R 13/518 439/364
5,820,401 A * 10/1998 Hasz ..... H01R 13/512 439/364
5,971,791 A * 10/1999 Itoh ..... H01R 13/5202 439/364
6,257,918 B1 * 7/2001 Yamamoto ..... H01R 13/6315 439/34
6,696,914 B2 * 2/2004 Haupt ..... H01H 85/0241 337/187
7,306,475 B2 * 12/2007 Tsuruta ..... H01R 4/30 439/364
7,588,449 B2 * 9/2009 Takehara ..... H01R 13/5219 439/247
8,297,900 B2 * 10/2012 Sumiya ..... F02F 7/006 411/369
8,348,689 B2 * 1/2013 Shibata ..... H01R 13/5202 439/271
8,465,313 B2 * 6/2013 Shibata ..... H01R 13/5202 439/271
8,622,674 B2 * 1/2014 Shibata ..... H01R 13/6215 411/366.1
9,048,572 B2 * 6/2015 Shibata ..... F16B 35/00
10,594,072 B2 * 3/2020 Lim ..... H01R 13/5219
10,916,883 B2 * 2/2021 Yamada ..... H01R 13/5202
2011/0182694 A1 * 7/2011 Nishikawa ..... H01R 13/6215 411/366.1
2011/0286786 A1 11/2011 Shibata
2012/0127677 A1 5/2012 Wakana et al.
2013/0260600 A1 10/2013 Shibata

FOREIGN PATENT DOCUMENTS

JP 2012-249050 12/2011
JP 2012-109161 6/2012
JP 2013-206860 10/2013

* cited by examiner

CONNECTOR FITTING BODY

BACKGROUND

Field of the Invention

The present invention relates to a connector fitting body in which a male housing and a female housing respectively holding terminals are fit using a bolt.

Related Art

A relay connector for relaying electrical wiring is used when connecting various electrical devices and the like to a control device. The relay connector forms a connector fitting body by fitting a male connector including male terminals and a female connector including female terminals to be conductive with the male terminals. A lever-type fitting structure utilizing the principle of leverage, a tightening-type fitting structure utilizing the tightening of a bolt and the like to facilitate fitting by a worker have been proposed as a fitting structure of a male connector and a female connector besides direct fitting by a worker.

Japanese Unexamined Patent Publication No. 2011-249050 discloses a connector fitting body having a tightening-type fitting structure where a housing and a mating housing are fit by tightening a bolt inserted through a bolt mounting portion of the housing to a nut provided in the mating housing.

In a conventional connector fitting body having a tightening-type fitting structure such as the one of Japanese Unexamined Patent Publication No. 2011-249050, a head of a bolt comes into contact with a bolt mounting portion that is a part of a housing, and the bolt is tightened to a nut to compress the bolt mounting portion between the head and the nut. That is, an axial force generated by tightening the bolt is applied to the nut via the bolt mounting portion made of a resin material for ensuring insulation with terminals. Thus, unless a bolt tightening torque is managed properly, the bolt mounting portion may be damaged. Further, the bolt tightening torque needs to be limited as appropriate in consideration of an axial force applied to the housing made of the resin material.

A larger tightening torque is required to tighten the bolt as more male terminals and female terminals are used and/or as the contact strength of the male terminals and the female terminals increases. A large tightening torque increases an axial force applied from the bolt to the housing.

Accordingly, to easily manage a bolt tightening torque in forming a tightening-type connector fitting body, a further structural ingenuity is required.

The present invention was developed in view of such a problem and is to provide a connector fitting body capable of protecting a first housing and a second housing from damage when a bolt is tightened and easily managing a bolt tightening torque.

SUMMARY

A first aspect of the invention is directed to a connector fitting body with a first housing holding first terminals and a second housing holding second terminals to be brought into contact and conduction with the first terminals by fitting the second housing to the first housing. A nut is arranged in a nut arrangement hole in the second housing, and a bolt including a head is arranged in a bolt arrangement hole in the first housing. A shaft extends coaxially from the head and can be engaged threadedly with the nut. The head includes a first step for pressing the first housing toward the second housing, and the nut includes a second step for pressing the second housing toward the first housing. An end surface of the head is in contact with an end surface of the nut.

A second aspect of the invention is directed to a connector fitting body with a first housing holding first terminals and a second housing holding second terminals to be brought into contact and conduction with the first terminals by fitting the second housing to the first housing. A nut is arranged in a nut arrangement hole provided in the second housing. A bolt includes a head portion and a shaft extending coaxially from the head. The shaft is inserted into a bolt insertion hole provided in the first housing and is engaged threadedly with the nut. A collar made of metal faces the nut and is arranged between an outer periphery of the shaft portion and an inner periphery of the bolt insertion hole. The collar includes a first step for pressing the first housing toward the second housing, and the nut includes a second step for pressing the second housing toward the first housing. An end surface of the collar is in contact with an end surface of the nut.

[Effects of Invention]

(Connector Fitting Body of the First Aspect)

The connector fitting body of the first aspect is a tightening type so that the first and second housings are fit by tightening the bolt to the nut. In this connector fitting body, when the bolt is tightened to the nut, the first step of the head of the bolt presses the first housing toward the second housing and the second step of the nut receives the second housing. In this way, the first housing approaches the second housing. Then, the end surface of the head contacts (is seated on) the end surface of the nut and the bolt is tightened to the nut.

At this time, the contact of the end surface of the head of the bolt with the end surface of the nut ensures that an axial force generated when the bolt is tightened does not act as a compression force on the first housing and the second housing. In this way, an excessive compression force does not act on the first and second housings when the bolt is tightened. Thus, the first and second housings can be protected from damage, and a tightening torque of the bolt need not be managed strictly. Further, a large tightening torque can be dealt with.

Therefore, the connector fitting body of the first aspect protects the first and second housings from damage when the bolt is tightened and the tightening torque of the bolt can be managed easily.

(Connector Fitting Body of the Second Aspect)

The connector fitting body of the second aspect is a tightening type so that the first and second housings are fit by tightening the bolt to the nut via the collar. In this connector fitting body, when the bolt is tightened to the nut via the collar, the first step of the collar presses the first housing toward the second housing and the second step of the nut receives the second housing. In this way, the first housing approaches the second housing. Then, the end surface of the collar contacts (is seated on) the end surface of the nut and the bolt is tightened to the nut.

At this time, the contact of the end surface of the collar with the end surface of the nut ensures that an axial force generated when the bolt is tightened acts as a compression force on the first and second housings. In this way, functions and effects similar to those of the connector fitting body of the first aspect are obtained also in the connector fitting body of the second aspect.

Therefore, the connector fitting body of the second aspect ensures the first and second housings can be protected from damage when the bolt is tightened and the tightening torque of the bolt can be managed easily.

DETAILED DESCRIPTION

Preferred embodiments according to the connector fitting body described above are described with reference to the drawings.

First Embodiment

Figure 1:
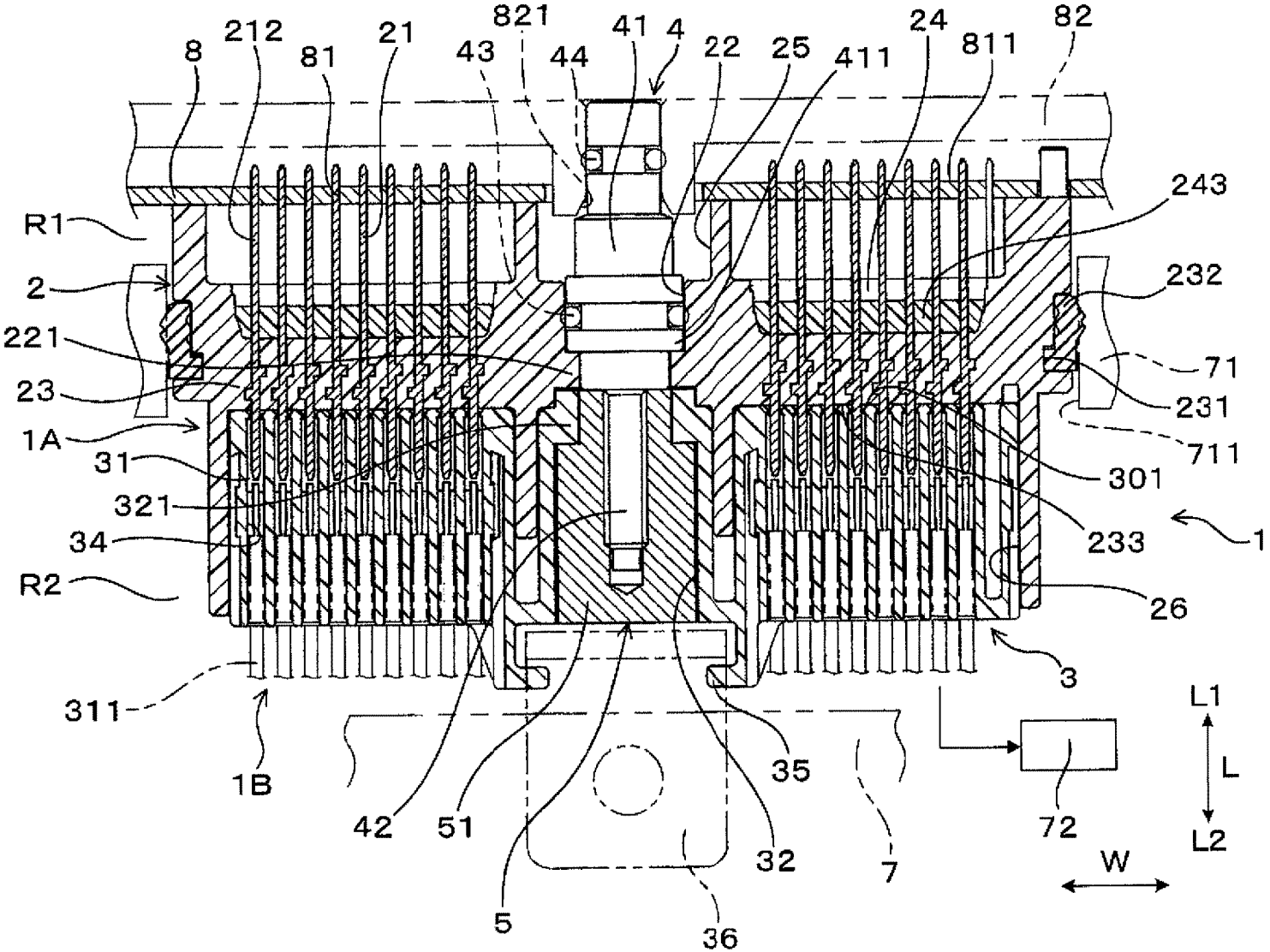
FIG. 1 is a front view in section of a connector fitting body according to a first embodiment.

A connector fitting body 1 of this embodiment includes, as shown in FIG. 1, a first housing 2, a second housing 3, a nut 5 and a bolt 4. First terminals 21 are held in the first housing 2 and second terminals 31 to be brought into contact and conduction with the first terminals 21 are held in the second housing 3. The nut 5 is arranged in a nut arrangement hole 32 in the second housing 3. The bolt 4 includes a head 41 arranged in a bolt arrangement hole 22 in the first housing 2 and a shaft 42 extends coaxially from the head 41 and is engaged threadedly with the nut 5.

Figure 2:
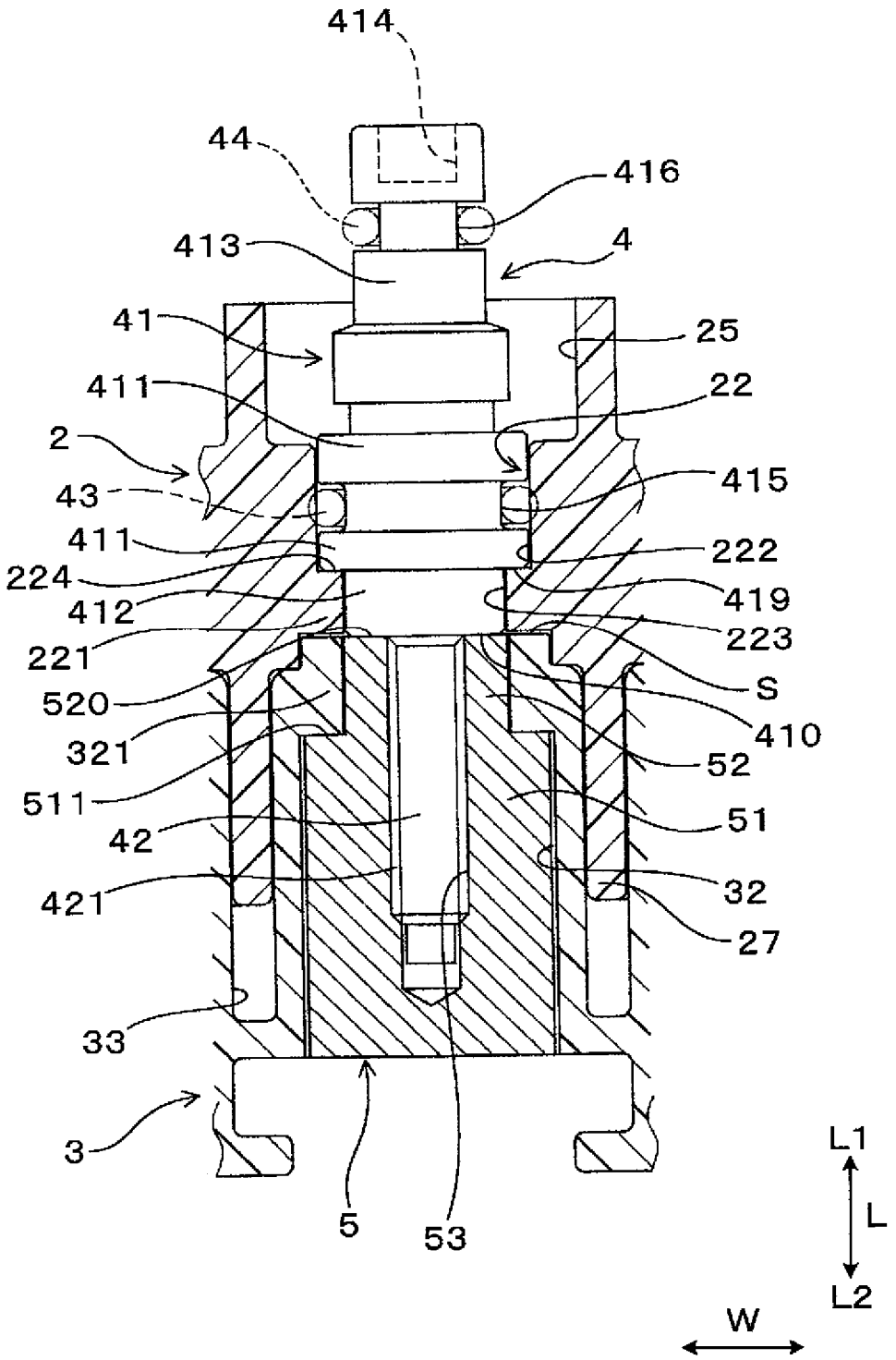
FIG. 2 is a section enlargedly showing a part of FIG. 1.

As shown in FIG. 2, the head 41 includes a large-diameter portion 411 serving as a first step for pressing the first housing 2 toward the second housing 3. The nut 5 includes a general portion 51 serving as a second step for pressing the second housing 3 toward the first housing 2. An end surface 410 of the head 41 is in contact with an end surface 520 of the nut 5.

The connector fitting body 1 of this embodiment is described in detail below.

(Connector Fitting Body 1 and Arrangement Environment Thereof)

As shown in FIG. 1, the connector fitting body 1 is used as a relay connector for relaying electrical wiring when various electronic control devices 72 are wired electrically to a control device (control board) 8. A control circuit for controlling the various electronic control devices 72 is formed on the control board 8. The connector fitting body 1 is formed by fitting a first connector 1A composed of the first terminals 21 and the first housing 2 and a second connector 1B composed of the second terminals 31 and the second housing 3.

The electronic control devices 72 can be mounted in various machine components 7. The machine component 7 of this embodiment is an automatic transmission mounted in an automotive vehicle and the electronic control devices 72 are a spool valve of a valve body, actuators such as a motor, sensors such as a resolver and the like used in the automatic transmission. The electronic control devices 72 are electrically connected to the control board 8 constituting an electronic control unit (ECU) via the plurality of first and second terminals 21, 31 of the connector fitting body 1. Note that the machine component 7 may be any one of various machine components other than the automatic transmission.

As shown in FIG. 1, oil (automatic transmission oil) is used for an automatic shift control operation, lubrication between constituent components and the like in the automatic transmission. The connector fitting body 1 is arranged in a case hole 711 provided in a case 71 of the automatic transmission. An outer peripheral sealing member 232 for oil to be held in contact with the inner periphery of the case hole 711 is mounted on the outer periphery of the first housing 2 of the connector fitting body 1. The outer peripheral sealing member 232 is arranged in an outer peripheral groove 231 formed in the outer periphery of the first housing 2. The outer peripheral sealing member 232 prevents leakage of the oil in the case 71 to the outside of the case 71 through a clearance between the connector fitting body 1 and the case hole 711.

When the connector fitting body 1 is arranged in the case hole 711, the second terminals 31 held in the second housing 3 are exposed to an oil environment R2 to be able to contact oil, a part of the first housing 2 projects from the case hole 711 and the first terminals 21 held in the first housing 2 are exposed to an air environment R1, i.e. to air.

As shown in FIGS. 1 to 10, a direction along an axial direction L of the bolt 4 is referred to as an axial direction L in the connector fitting body 1 of this embodiment. Further, a direction along long sides of the connector fitting body 1 in a plane perpendicular to the axial direction L is referred to as a width direction W, and a direction along short sides of the connector fitting body 1 in the plane perpendicular to the axial direction L is referred to as a thickness direction B. Further, in the axial direction L of the connector fitting body 1, a side where the first connector 1A is located and that is exposed to the air environment R1 is referred to as an air side L1 and a side where the second connector 1B is located and that is exposed to the oil environment R2 is referred to as an oil side L2.

(Bolt 4)

Figure 3:
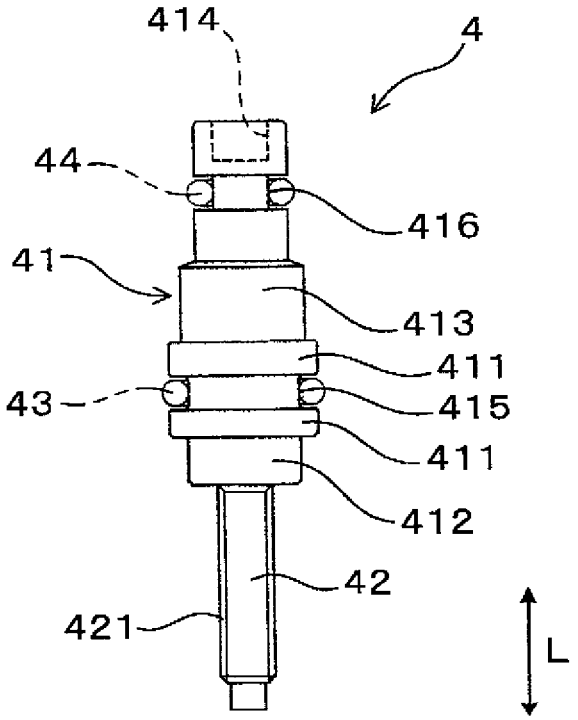
FIG. 3 is a view showing a bolt according to the first embodiment.

As shown in FIGS. 2 and 3, the bolt 4 is arranged at a center position in the width direction W and the thickness direction B of the connector fitting body 1. The bolt 4 is a special bolt whose head 41 has a sealing function. The bolt 4 is made of a metal material. The head 41 of the bolt 4 is formed into a stepped shape by the large-diameter portion 411 serving as the first step to press the first housing 2 toward the second housing 3 when an axial force is generated by bolt tightening.

The head 41 of this embodiment includes a small-diameter portion 412 formed on an end part on the side of the second housing 3 (oil side L2) and the large-diameter portion 411 serving as the first step, larger in diameter than the small-diameter portion 412 and formed adjacent to the small-diameter portion 412 on the side of the first housing 2 (air side L1). A first projection 221 is formed in the bolt arrangement hole 22 of the first housing 2 and is to be pressed toward the second housing 3 by the large-diameter portion 411. The first projection 221 is located on an outer peripheral side of the small-diameter portion 412 and projects toward an inner peripheral side of the bolt arrangement hole 22. The first projection 221 of this embodiment is formed by narrowing a part in the axial direction L of the bolt arrangement hole 22.

The first projection 221 is a part of the first housing 2 for receiving an axial force (thrust force) generated when the bolt 4 is tightened. Further, the first projection 221 is also a part for maintaining a state where the first and second housings 2, 3 are fit.

As shown in FIGS. 2 and 3, a first groove 415 is formed in the outer periphery of the large-diameter portion 411, and the oil-proof sealing member 43 is mounted in this first groove 415 for sealing the clearance between the large-diameter portion 411 and the bolt arrangement hole 22. The oil-proof sealing member 43 is an O-ring made of rubber. The oil-proof sealing member 43 may be one of various packings capable of sealing oil beside the O-ring. Note that the oil-proof sealing member 43 may be mounted on the outer periphery of the small-diameter portion 412.

The oil-proof sealing member 43 ensures that oil penetrating into the clearance between the head 41 of the bolt 4 and the bolt arrangement hole 22 through a clearance between the nut 5 and the nut arrangement hole 32 cannot further penetrate to the control board 8.

As shown in FIGS. 2 and 3, the large-diameter portion 411 and the small-diameter portion 412 have a circular cross-sectional shapes. A hollow cylindrical portion 413 having a circular cross-sectional shape and coaxially connected to the large-diameter portion 411 is formed on the air side L1 of the large-diameter portion 411 in the axial direction L. The hollow cylindrical portion 413 is formed on an end of the head 41 on the air side L1 opposite to the shaft 42.

A tool engaging portion 414 with which a tightening tool is engaged is formed on an end part of the hollow cylindrical portion 413 on the air side L1. The tool engaging portion 414 of this embodiment is formed by a hexagonal recess. Further, as shown in FIGS. 1 and 2, a second groove portion 416 is formed in the outer periphery of the hollow cylindrical portion 413, and a waterproof sealing member 44 for sealing a clearance between the head portion 41 and a through hole 821 formed in a cover 82 for covering the control board 8 is mounted in this second groove portion 416.

The waterproof sealing member 44 prevents the entrance of water to the control board 8 through the clearance between the head 41 of the bolt 4 and the through hole 821 even if the cover 82 of the control board 8 is wetted.

An external thread 421 is formed on the outer periphery of the shaft 42 of the bolt 4. The external thread 421 of the shaft 42 of this embodiment is formed up to a boundary position with the head 41. Note that, although not shown, an escape groove is formed on the shaft 42 at the time of threading and is at the boundary position with the head 41.

(Nut 5)

Figure 4:
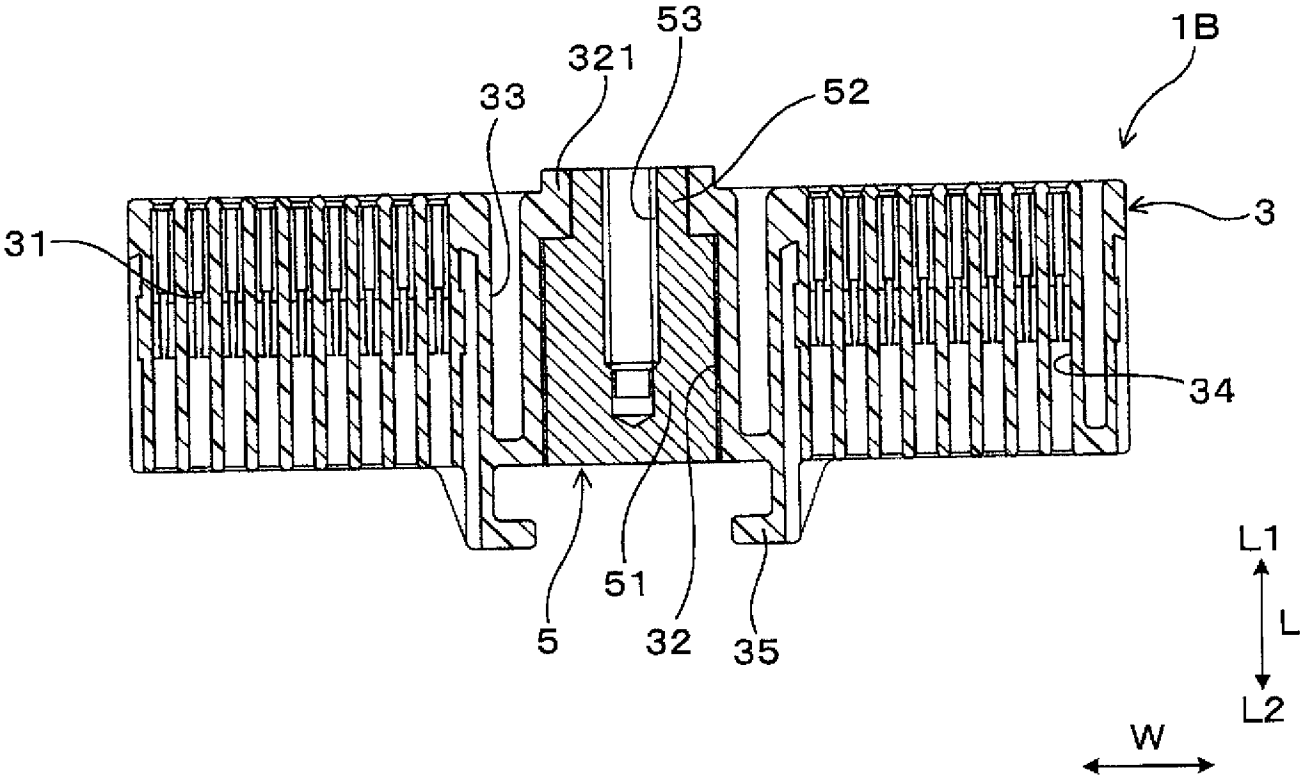
FIG. 4 is a front view in section of a second connector of the connector fitting body of the first embodiment.

As shown in FIGS. 3 and 4, the nut 5 is formed with an internal thread (screw hole) 53 to be engaged threadedly with the external thread 421 of the shaft 42 of the bolt 4. The nut 5 is made of metal and is arranged in the nut arrangement hole 32 of the second housing 3, thereby being prevented from turning when the bolt 4 is tightened. The nut 5 of this embodiment has a rectangular cross-sectional shape and is prevented from turning with respect to the nut arrangement hole 32. Note that the nut 5 may have one of various shapes capable of preventing turning with respect to the nut arrangement hole 32.

The nut 5 is formed into a stepped shape by the general portion 51 serving as the second step for pressing the second housing 3 toward the first housing 2 when receiving an axial force due to the tightening of the bolt 4. The nut 5 of this embodiment also includes a reduced portion 52 smaller than the general portion 51 in the width direction W and the thickness direction B and formed adjacent to the general portion 51 on the side of the first housing 2.

The general portion 51 of this embodiment is formed into a rectangular parallelepiped shape, and the reduced portion 52 is formed into a hollow cylindrical shape. Note that the reduced portion 52 may be smaller than the general portion 51 in at least one of the width direction W and the thickness direction B. As shown in FIG. 2, a second projection 321 is formed in the nut arrangement hole 32 of the second housing 3 and is to be pressed toward the first housing 2 by the general portion 51. The second projection 321 is on an outer peripheral side of the reduced portion 52 and projects toward an inner peripheral side of the nut arrangement hole 32.

The second projection 321 is a part of the second housing 3 for receiving an axial force (thrust force) generated when the bolt 4 is tightened. Further, the second projection 321 is a part for maintaining the state where the first and second housings 2, 3 are fit.

As shown in FIGS. 2 and 4, the nut 5 can be arranged in the second housing 3 by insert-molding the second housing 3. Alternatively, the nut 5 can be arranged in the nut arrangement hole 32 of the second housing 3 after the second housing 3 is molded. The bolt arrangement hole 22 of the first housing 2 and the nut arrangement hole 32 of the second housing 3 communicate with each other in the connector fitting body 1.

(First Terminals 21)

As shown in FIG. 1, the connector fitting body 1 of this embodiment is mounted on a printed board serving as the control board 8. The first terminals 21 are conductor pins made of a conductive metal and serving as male terminals to be conductive with conductor portions 811 on the control board 8. The first terminal 21 is inserted through a through hole 81 formed in the control board 8 and electrically connected to the conductor portion 811 of the control board 8 by soldering or the like.

Figure 5:
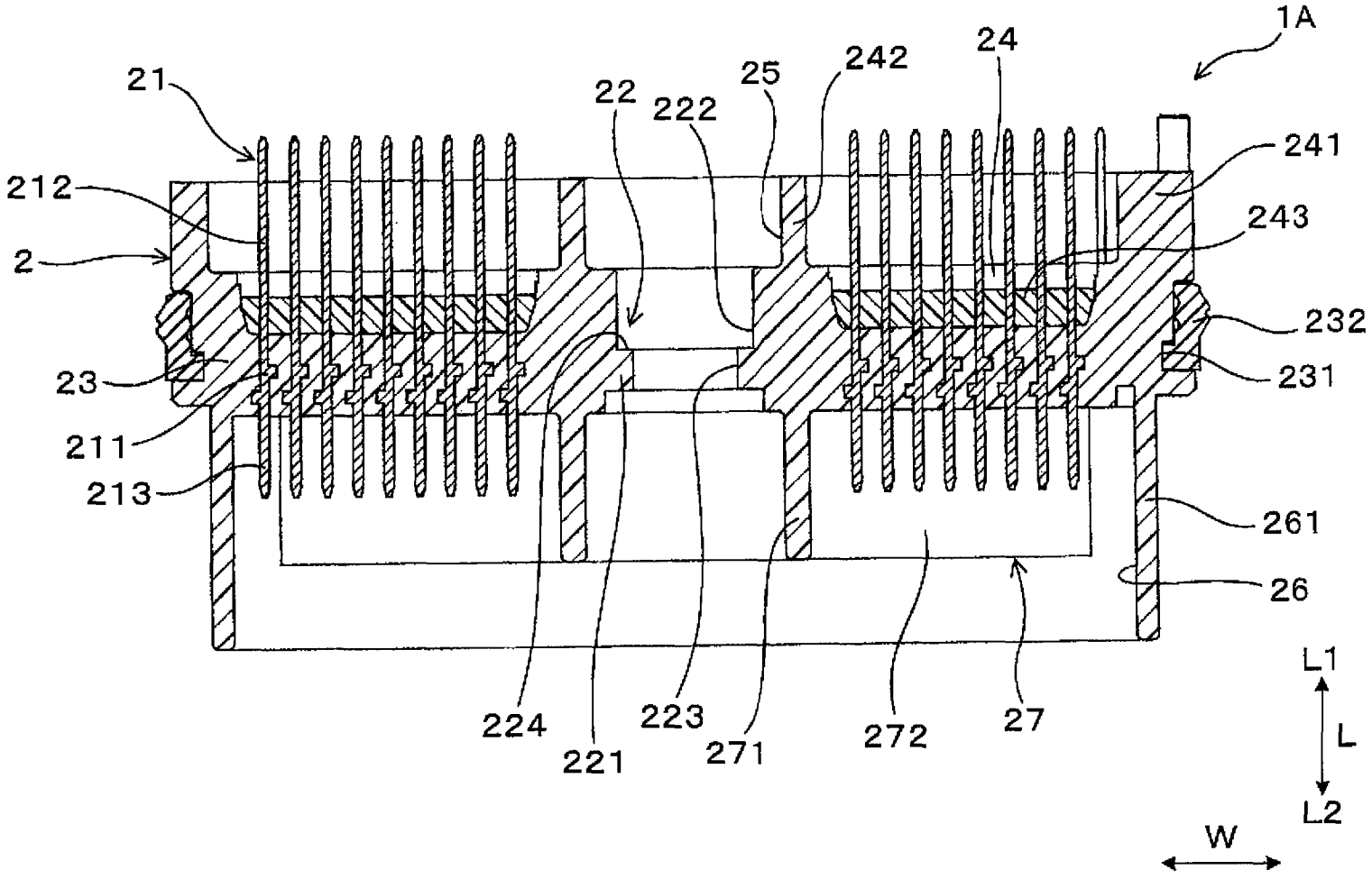
FIG. 5 is a front view in section of a first connector of the connector fitting body according to the first embodiment.

As shown in FIG. 5, intermediate parts 211 of the first terminals 21 are embedded in a facing plate 23 of the first housing 2 facing the second housing 3. Both end parts 212, 213 of the first terminals 21 project toward opposite sides in the axial direction L from the facing plate 23. The first end parts 212 of the first terminal 21 on the air side L1 are connected to the control board 8. The second end parts 213 of the first terminals 21 on the oil side L2 are connected to the respective second terminals 31.

(Second Terminals 31)

As shown in FIG. 1, wires 311 wired to the electronic control devices 72 in the oil environment R2 are connected to the second terminals 31. Each second terminal 31 is made of a conductive material. The plurality of second terminals 31 constitute female terminals and are held in terminal holes 34 formed in the second housing 3.

The first terminals 21 and the second terminals 31 are arranged side by side in the width direction W and the thickness direction B orthogonal to the axial direction L while being parallel to the axial direction L of the bolt 4. The first terminals 21 are arranged in a divided manner on both sides of the bolt arrangement hole 22 in the width direction W, and the second terminals 31 are arranged in a divided manner on both sides of the nut arrangement hole 32 in the width direction W.

(First Housing 2)

Figure 6:
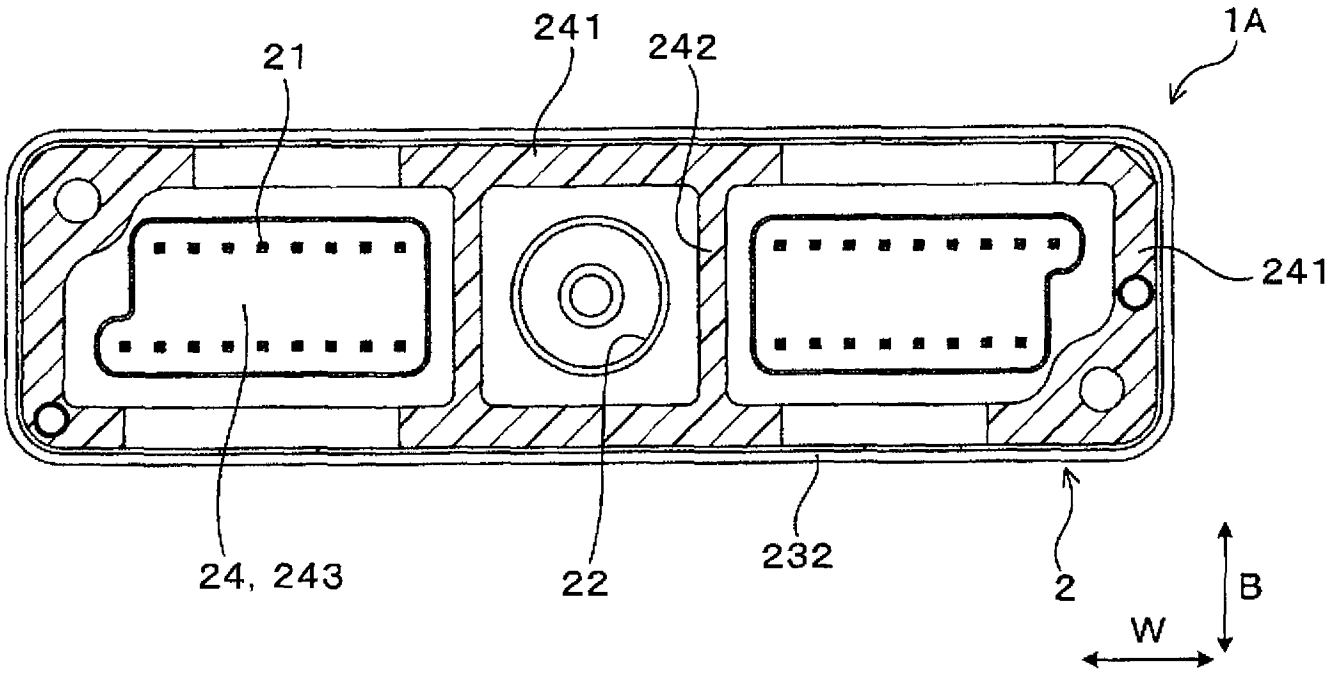
FIG. 6 is a view of the first connector of the connector fitting body according to the first embodiment viewed from an air side.

As shown in FIGS. 5 and 6, the first housing 2 forms the first connector 1A serving as a male connector and is formed by insert-molding a resin material, such as a thermoplastic resin, with the first terminals 21 inserted. The first housing 2 includes the facing plate 23 facing the second housing 3, arrangement recesses 24 formed on the air side L1 of the facing plate 23 to arrange the first end parts 212 of the first terminals 21, a head recess 25 formed on the air side L1 of the facing plate 23 to arrange the head 41 of the bolt 4, and fitting recesses 26 formed on the oil side L2 of the facing plate 23, with the second connector 1B (second housing 3) being fit into the fitting recesses 26.

The bolt arrangement hole 22 penetrates through the facing plate 23 in the axial direction L at the center position of the first housing 2 in the width direction W and the thickness direction B. The first projection 221 projects toward the inner peripheral side over the entire inner periphery of the bolt arrangement hole 22. As shown in FIGS. 2 and 5, by forming the first projection 221, the bolt arrangement hole 22 is divided into a large-diameter hole portion 222 in which the large-diameter portion 411 of the head 41 of the bolt 4 is arranged and a small-diameter hole portion 223 that is adjacent to the large-diameter hole portion 222 on the oil side L2 and in which the small-diameter portion 412 of the head 41 of the bolt 4 is arranged.

As shown in FIG. 2, a step surface 224 formed by an end surface of the first projection 221 is formed between the large-diameter hole portion 222 and the small-diameter hole portion 223. When the bolt 4 is turned about a center axis thereof, an end surface 419 of the large-diameter portion 411 comes into contact with the step surface 224 of the first projection 221 and the first housing 2 is slid in the axial direction L.

Figure 7:
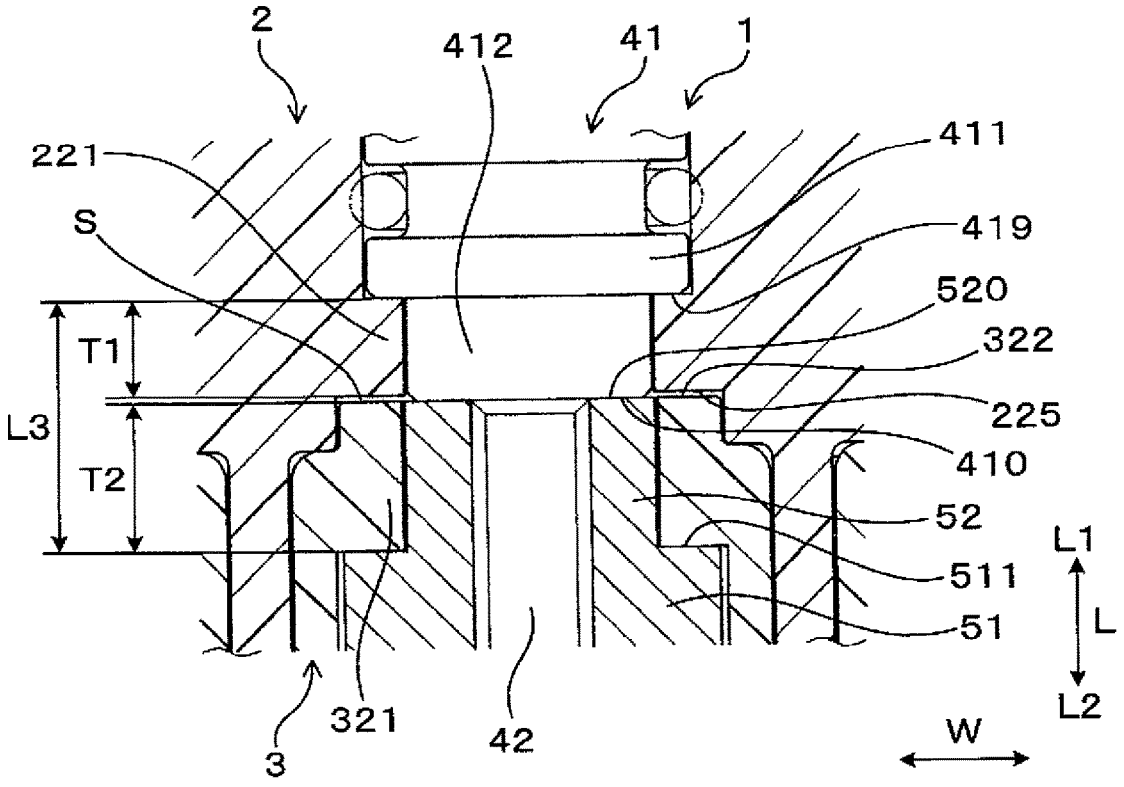
FIG. 7 is a section further enlargedly showing a part of FIG. 2.

With the first and second connectors 1A, 1B fit, the end surface 419 of the large-diameter portion 411 and the step surface 224 of the first projection 221 face each other, as shown in FIG. 2, and an end surface 233 on the oil side L2 of the facing plate 223 of the first housing 2 faces an end surface 301 on the air side L1 of the second housing 3, as shown in FIG. 1. On the other hand, in this state, a clearance S is formed between an end surface 225 on the oil side L2 of the first projection 221 and an end surface 322 on the air side L1 of the second projection 321 as shown in FIGS. 2 and 7.

By forming this clearance S, the first projection 221 is prevented from being sandwiched between the bolt 4 and the nut 5 when the bolt 4 is tightened to the nut 5. Thus, an axial force generated by tightening the bolt 4 is less likely to act as a compression force on the first projection 221.

As shown in FIGS. 5 and 6, the arrangement recesses 24 are formed on both sides of the head recess 25 in the width direction W. The arrangement recesses 24 are formed by being surrounded by an air-side outer wall 241 projecting toward the air side L1 from an entire outer peripheral part of the facing plate 23 and partition walls 242 formed in the air-side outer wall 241. The partition walls 242 are formed on both sides of the head 41 of the bolt 4 in the width direction W, and the head recess 25 is formed between two of the partition walls 242.

A sealing resin portion 243 made of an adhesive, such as a thermosetting resin, is formed on a bottom part of the arrangement recess 24. The sealing resin portion 243 is formed in contact with the entire periphery of each first terminal 21. Even if oil penetrates into a clearance between each first terminal 21 and the first housing 2, the sealing resin portion 243 prevents the penetration of this oil to the control board 8 along each first terminal 21.

Figure 8:
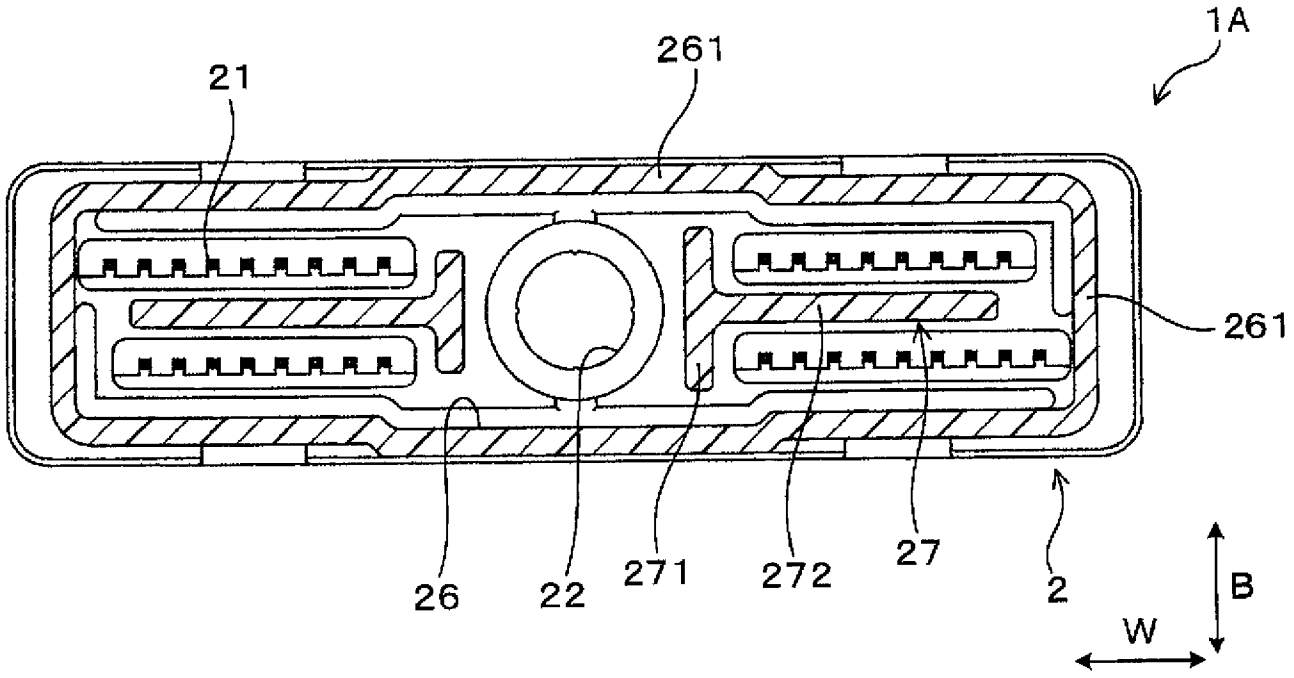
FIG. 8 is a view of the first connector the connector fitting body according to the first embodiment viewed from an oil side.

As shown in FIGS. 5 and 8, the fitting recesses 26 are formed on both sides of the nut arrangement hole 32 in the width direction W. The fitting recesses 26 are formed by being surrounded by an oil-side side wall 261 projecting toward the oil side L2 from the entire outer peripheral part of the facing plate 23. Further, two ribs 27 projecting from the facing plate 23 of the first housing 2 toward the oil side L2 are formed in the fitting recesses 26 on both sides of the bolt arrangement hole 22 in the width direction W. These ribs 27 are utilized to guide a sliding movement of the second housing 3 in the axial direction L with respect to the first housing 2 when the second housing 3 is fit to the first housing 2.

Figure 9:
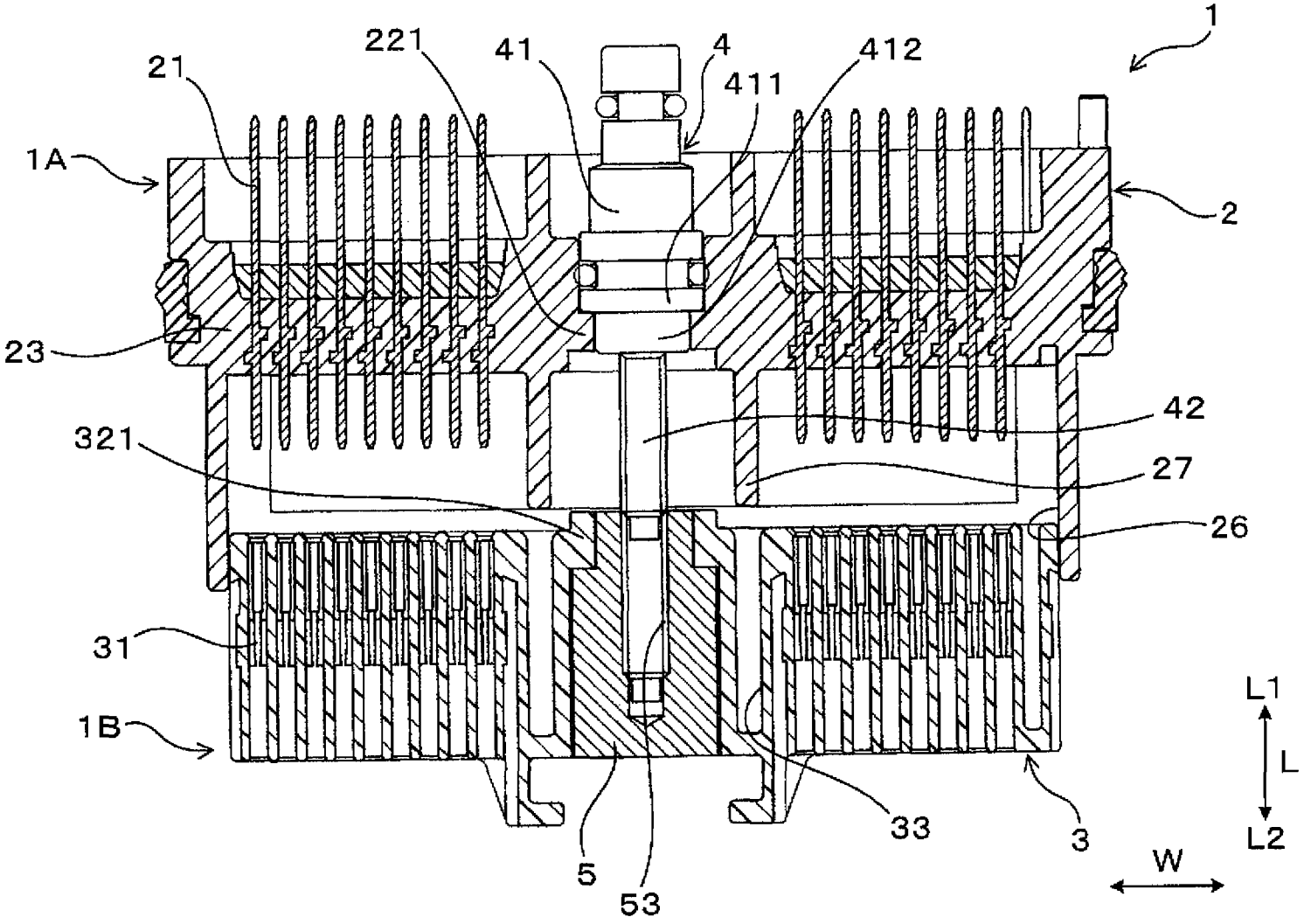
FIG. 9 is a front view in section showing a state where the first and second connectors according to the first embodiment are fit to form the connector fitting body.

The ribs 27 extend out in the width direction W from positions adjacent to the sides of the bolt arrangement hole 22 in the width direction W. Projecting amounts of the ribs 27 toward the oil side L2 from the facing plate 23 are larger than those of the second end parts 213 of the first terminals 21 toward the oil side L2 from the facing plate 23. In this way, the guiding of the second connector 1B by the ribs 27 can be started before the second terminals 31 contact the first terminals 21 when the second connector 1B is fit into the fitting recesses 26 of the first connector 1A, as shown in FIG. 9.

Further, as shown in FIG. 8, the rib 27 includes a first rib portion 271 extending in the thickness direction B at the position adjacent to one of the sides of the bolt arrangement hole 22 in the width direction W and a second rib portion 272 extending outward in the width direction W from a central part of the first rib portion 271 in the thickness direction B. The rib 27 is in the form of a T-shaped wall by combining the first and second rib portions 271, 272.

The first terminals 21 are arranged in the width direction W in each of two rows. The second rib portion 272 is arranged between the two terminal rows to divide the two terminal rows in the thickness direction B. The second rib portion 272 increases a creepage distance for insulation between the first terminals 21 in the respective terminal rows.

Figure 10:
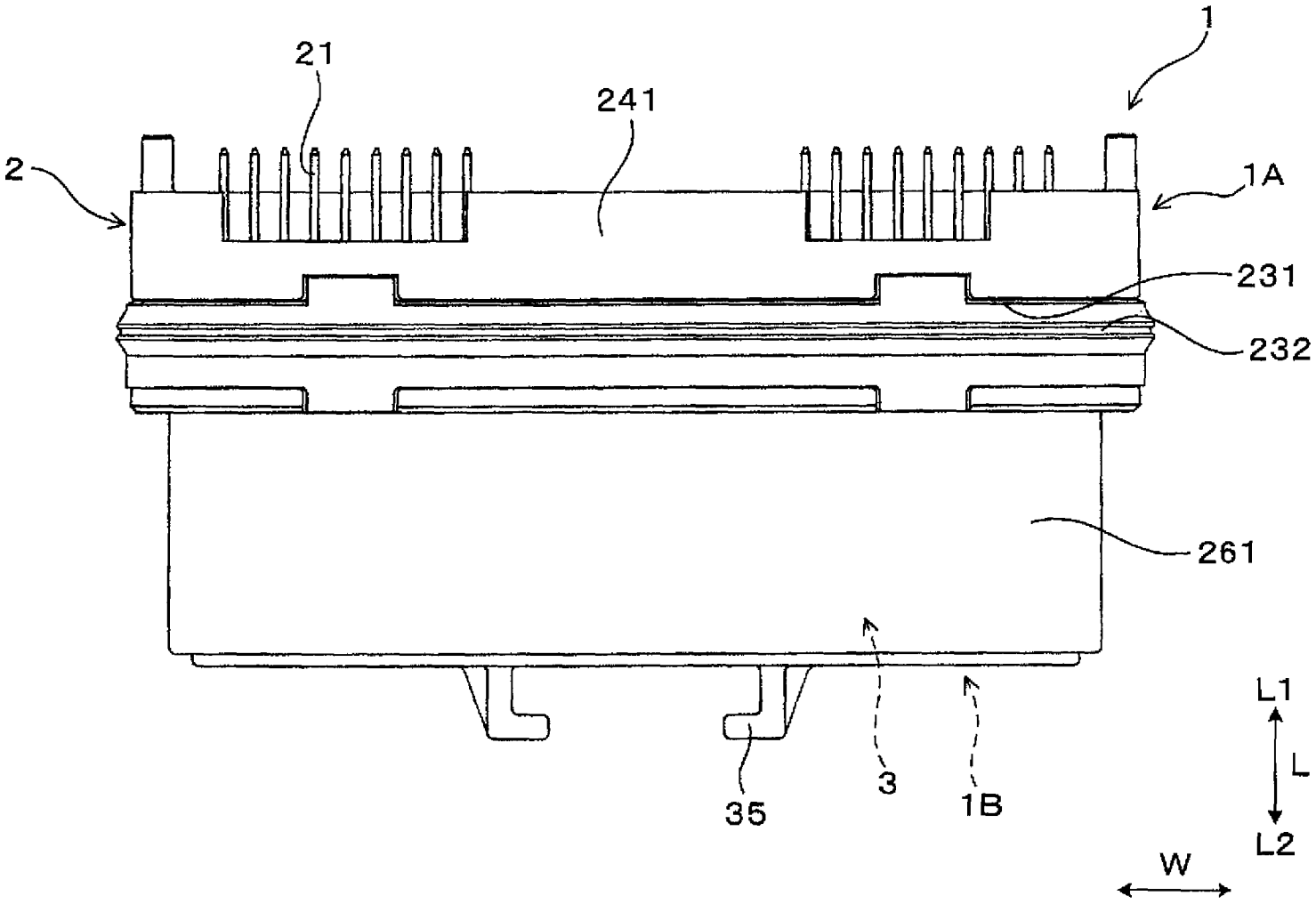
FIG. 10 is a front view showing the connector fitting body according to the first embodiment.

As shown in FIGS. 6 and 10, the first and second housings 2, 3 have rectangular outer shapes orthogonal to the axial direction L. The outer peripheral sealing member 232 mounted on the outer periphery of the first housing 2 is made of a rubber material and is formed into a rectangular shape. The rectangular outer peripheral sealing member 232 enables oil to be sealed in a small space of the connector fitting body 1.

(Second Housing 3)

As shown in FIGS. 4 and 9, the second housing 3 forms the second connector 1B serving as a female connector and is formed by molding a resin material, such as a thermoplastic resin. The second housing 3 is formed with rib holes 33 into which the ribs 27 of the first housing 2 are inserted. Each rib hole 33 is formed in conformity with the entire or partial shape of the rib 27 to guide the rib 27 in the axial direction L. Each rib hole 33 extends from an end part on the air side L1 toward the oil side L2.

The connector fitting body 1 is devised to prevent erroneous fitting of the first and second housings 2, 3. Specifically, in the first housing 2, a length in the thickness direction B of the first rib portion 271 of one rib 27 is longer than that of the first rib portion 271 of the other rib 27. In the second housing 3, a length of one rib hole 33 in the thickness direction B matches the length in the thickness direction B of the first rib portion 271 of the one rib 27. Further, in the second housing 3, a length of the other rib hole 33 in the thickness direction B matches the length in the thickness direction B of the first rib portion 271 of the other rib 27.

The first and second housings 2, 3 can be fit to each other only when the one rib 27 and the one rib hole 33 are aligned and the other rib 27 and the other rib hole 33 are aligned. In this way, the first and second housings 2, 3 are prevented from being fit in inverted postures.

Further, as shown in FIG. 1, a bracket 36 is mounted on the second housing 3 for loosely movably mounting the connector fitting body 1 on the automatic transmission serving as the machine component 7. The second housing 3 is formed with an engaging portion 35 to be loosely movably engaged with the bracket 36. The connector fitting body 1 is loosely movably supported on the automatic transmission by the bracket 36. When the case 71 is mounted on the automatic transmission, the connector fitting body 1 loosely moves with respect to the automatic transmission so that the connector fitting body 1 easily can be arranged in the case hole 711 of the case 71.

(Dimensional Relationship)

Further, in the connector fitting body 1 of this embodiment, the following dimensional relationship is managed to make a compression force difficult to act in the axial direction L on the first and second projections 221, 321.

Specifically, as shown in FIG. 7, a distance L3 in the axial direction L between the end surface 419 on the oil side L2 of the large-diameter portion (first step) 411 on the head 41 of the bolt 4 and the end surface 511 on the air side L1 on the general portion (second step) of the nut 5 is longer than the sum of a thickness T1 in the axial direction L of the first projection 221 and a thickness T2 in the axial direction L of the second projection 321. This dimensional relationship is satisfied by forming the clearance S between the end surface 225 on the oil side L2 of the first projection 221 and the end surface 322 on the air side L1 of the second projection 321.

Further, as shown in FIG. 1, a tightening force generated between the large-diameter portion 411 on the head 41 of the bolt 4 and the general portion 51 of the nut 5 acts on the first and second housings 2, 3 outside a region in the width direction W and the thickness direction B where the first and second projections 221, 321 are formed. Specifically, the first and second housings 2, 3 are sandwiched between the large-diameter portion 411 on the head 41 of the bolt 4 and the general portion 51 of the nut 5 by facing surfaces of the large-diameter portion 411 and the first projection 221, facing surfaces of the facing plate 23 of the first housing 2 and the second housing 3 and facing surfaces of the general portion 51 and the second projection 321.

(Assembling/Arranging Method of Connector Fitting Body 1)

Next, a case where the connector fitting body 1 is used as a relay connector is described.

Assembling the connector fitting body 1 involves preparing: the first connector 1A with the first terminals 21 in the first housing 2, the second connector 1B with the second terminals 31 in the second housing 3, the bolt 4 and the nut 5 having the oil-proof sealing member 43 and the waterproof sealing member 44 mounted thereon, as shown in FIG. 9. Further, the wires 311 are connected to the respective second terminals 31 of the second connector 1B. Then, the bolt 4 is arranged in the bolt arrangement hole 22 of the first connector 1A, and the nut 5 is arranged in the nut arrangement hole 32 of the second connector 1B.

Subsequently, the first and second connectors 1A, 1B are caused to face each other with the first terminals 21 and the second terminals 31 facing each other. Then, as shown in FIG. 1, the bolt 4 is turned by the tool engaged with the tool engaging portion 414 of the head 41 to engage the external thread 421 of the shaft 42 of the bolt 4 threadedly with the internal thread 53 of the nut 5. As the bolt 4 is turned, the large-diameter portion (first step) 411 of the head 41 of the bolt 4 presses the first projection 221 of the first housing 2 toward the second housing 3. Further, the general portion (second step) 51 of the nut 5 receives the second projection 321 of the second housing 3. In this way, the first connector 1A approaches the second connector 1B, and the first terminals 21 are inserted into the terminal holes 34 having the respective second terminals 31 arranged therein.

Subsequently, the bolt 4 is tightened to the nut 5 and the first terminals 21 are connected to the respective second terminals 31. When the end surface 410 of the small-diameter portion 412 on the head 41 of the bolt 4 comes into contact with the end surface 520 of the nut 5, the first and second projections 221, 321 are not sandwiched between the large-diameter portion 411 of the head 41 and the general portion 51 of the nut 5. Thus, a tightening force of the bolt 4 is received directly by the nut 5. In this way, the connector fitting body 1 in which the first and second connectors 1A, 1B are fit is formed.

Subsequently, as shown in FIG. 1, the connector fitting body 1 is mounted on the automatic transmission of the machine component 7 by the bracket 36 mounted on the engaging portion 35 of the second connector 1B. Subsequently, when the case 71 is mounted on the automatic transmission, the connector fitting body 1 can be moved loosely with respect to the automatic transmission by the bracket 36 and the connector fitting body 1 easily is arranged in the case hole 711 of the case 71.

Subsequently, the control board 8 is arranged on the first connector 1A of the connector fitting body 1. At this time, the first end parts 212 of the respective first terminals 21 projecting toward the air side L1 from the first connector 1A are inserted into the through holes 81 of the control board 8. Then, the first end parts 212 of the respective first terminals 21 are joined to the conductor portions 811 of the control board 8 by soldering or the like. Thereafter, the control board 8 is covered by the cover 82.

(Functions and Effects)

The connector fitting body 1 of this embodiment is of a tightening type such that the first and second housings 2, 3 are fit by tightening the bolt 4 to the nut 5. In the connector fitting body 1, when the bolt 4 is tightened to the nut 5, the large-diameter portion (first step) 411 of the head 41 of the bolt 4 presses the first housing 2 toward the second housing 3 and the general portion (second step) 51 of the nut 5 receives the second housing 3. In this way, the first housing 2 approaches the second housing 3. Then, the end surface 410 of the small-diameter portion 412 of the head 41 contacts (is seated on) the end surface 520 of the nut 5 and the bolt 4 is tightened to the nut 5.

The bolt 4 and the nut 5 are made of the metal, and the first and second housings 2, 3 are made of the resin to ensure insulation properties. The first and second housings 2, 3 are lower in strength than the bolt 4 and the nut 5. In the connector fitting body 1 of this embodiment, the metal materials higher in strength than the resin materials can be bonded by the direct contact of the bolt 4 with the nut 5.

The contact of the end surface 410 of the small-diameter portion 412 on the head 41 of the bolt 4 with the end surface 520 of the nut 5 ensures that an axial force generated when the bolt 4 is tightened does not act as a compression force on the first project 221 of the first housing 2 and the second projection 321 of the second housing 3. In this way, an excessive compression force does not act on the first and second projections 221, 321 when the bolt 4 is tightened. Thus, the first and second projections 221, 321 can be protected from damage, and a tightening torque of the bolt 4 need not be managed strictly. Further, a large tightening torque can also be dealt with.

One feature of the connector fitting body 1 to be mounted on the printed board is that the conductor pins serving as the first terminals 21 are arranged densely. The connector fitting body 1 of this embodiment includes 30 or more first terminals 21 and second terminals 31. When the first connector 1A including the first terminals 21 and the second connector 1B including the second terminals 31 are fit, the first terminals 21 and the second terminals 31 simultaneously contact each other. Thus, at the time of this fitting, a tightening axial force acting in the axial direction L on the first connector 1A (first housing 2) and the second connector 1B (second housing 3) needs to be increased.

To increase the tightening axial force, the tightening torque of the bolt 4 needs to be increased. At this time, when the head 41 of the bolt 4 is seated on a surface to be tightened, the axial force applied to the surface to be tightened also increases. In a conventional connector fitting body 1, a surface to be tightened is constituted by a housing made of a resin material. Thus, in the conventional connector fitting body 1, a bolt 4 needs to be tightened while the axial force applied to the surface to be tightened is limited appropriately.

In contrast, in the connector fitting body 1 of this embodiment, the surface to be tightened is formed by the nut 5 made of metal. An axial force due to the tightening of the bolt 4 is less likely to act on the first and second projections 221, 321. In this way, the axial force due to the tightening of the bolt 4 can be increased while the first and second projections 221, 321 are protected.

Therefore, according to the connector fitting body 1 of this embodiment, the first and second housings 2, 3 can be protected from damage when the bolt 4 is tightened and the tightening torque of the bolt 4 can be managed easily.

Further, the connector fitting body 1 was developed in consideration of use in the oil environment R2 in which oil is used. Particularly, the oil-proof sealing member 43 for sealing the clearance between the large-diameter portion 411 and the bolt arrangement hole 22 is mounted on the outer periphery of the large-diameter portion 411 of the head 41 of the bolt 4. By arranging this oil-proof sealing member 43, the oil cannot pass through the clearance between the head 41 of the bolt 4 and the bolt arrangement hole 22. Further, the sealing resin portion 243 for preventing the penetration of the oil is provided around the first terminals 21. Furthermore, the outer peripheral sealing member 232 is mounted on the outer periphery of the first housing 2. By these configurations, the leakage of the oil in the oil environment R2 used in the automatic transmission to the control board 8 in the air environment R1 or to the outside of the case 71 of the automatic transmission can be prevented.

Note that it is also possible not to use members for sealing the oil such as the oil-proof sealing member 43, the sealing resin portion 243 and the outer peripheral sealing member 232 if the connector fitting body 1 is used in such an environment that liquid such as water or oil is not present.

Second Embodiment

Figure 11:
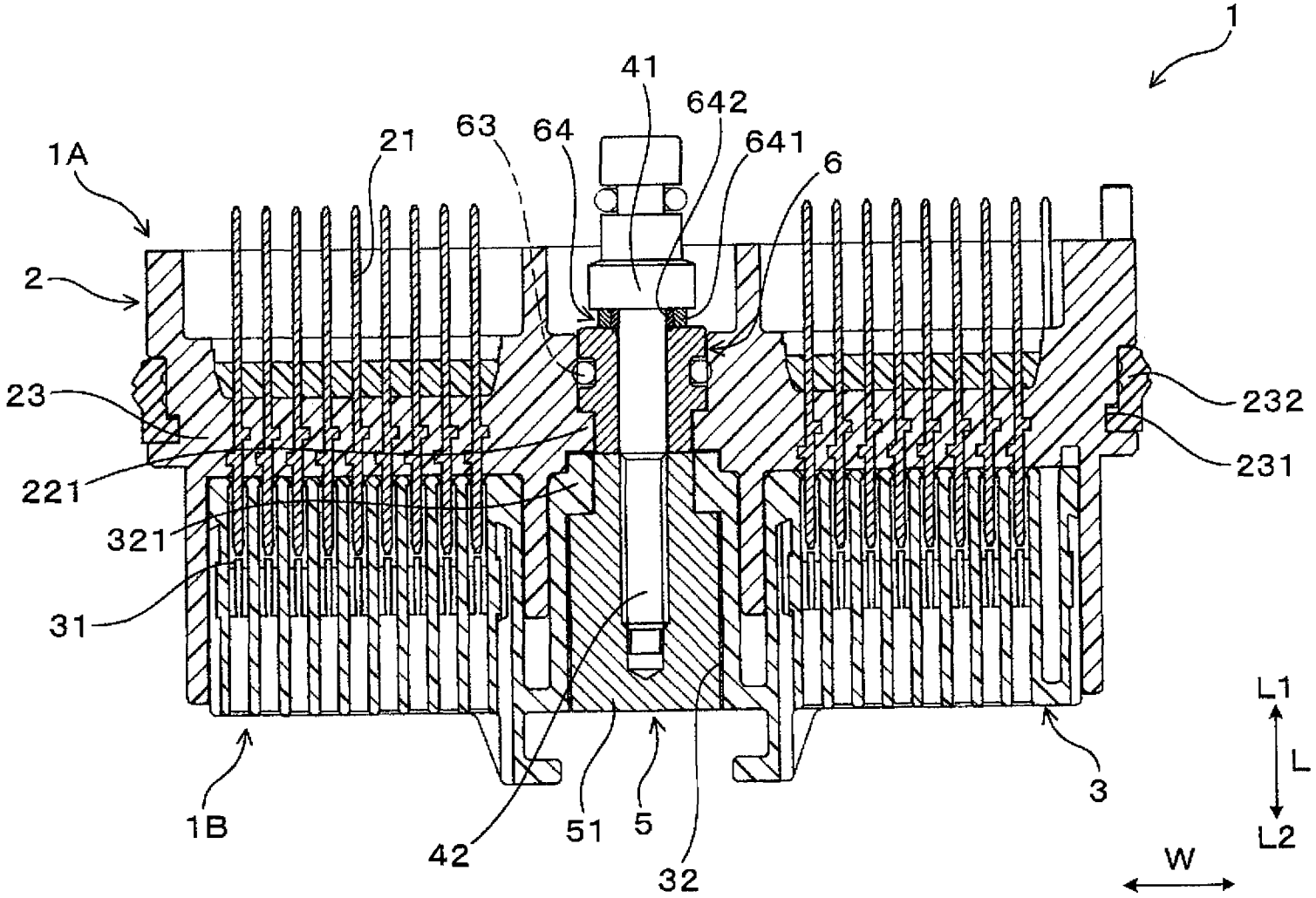
FIG. 11 is a front view in section showing a connector fitting body according to a second embodiment.

A connector fitting body 1 of a second embodiment differs from the connector fitting body 1 of the first embodiment in that a collar 6 made of metal is used when a bolt 4 is fastened to a nut 5 as shown in FIG. 11. In the connector fitting body 1 of this embodiment, the collar 6 made of metal is mounted on the outer periphery of a shaft 42 of the bolt 4 and the bolt 4 is tightened to the nut 5 via the collar 6. Further, as shown in FIG. 12, an end surface 620 of the collar 6 is in contact with an end surface 520 of the nut 5 with the bolt 4 tightened to the nut 5.

Figure 12:
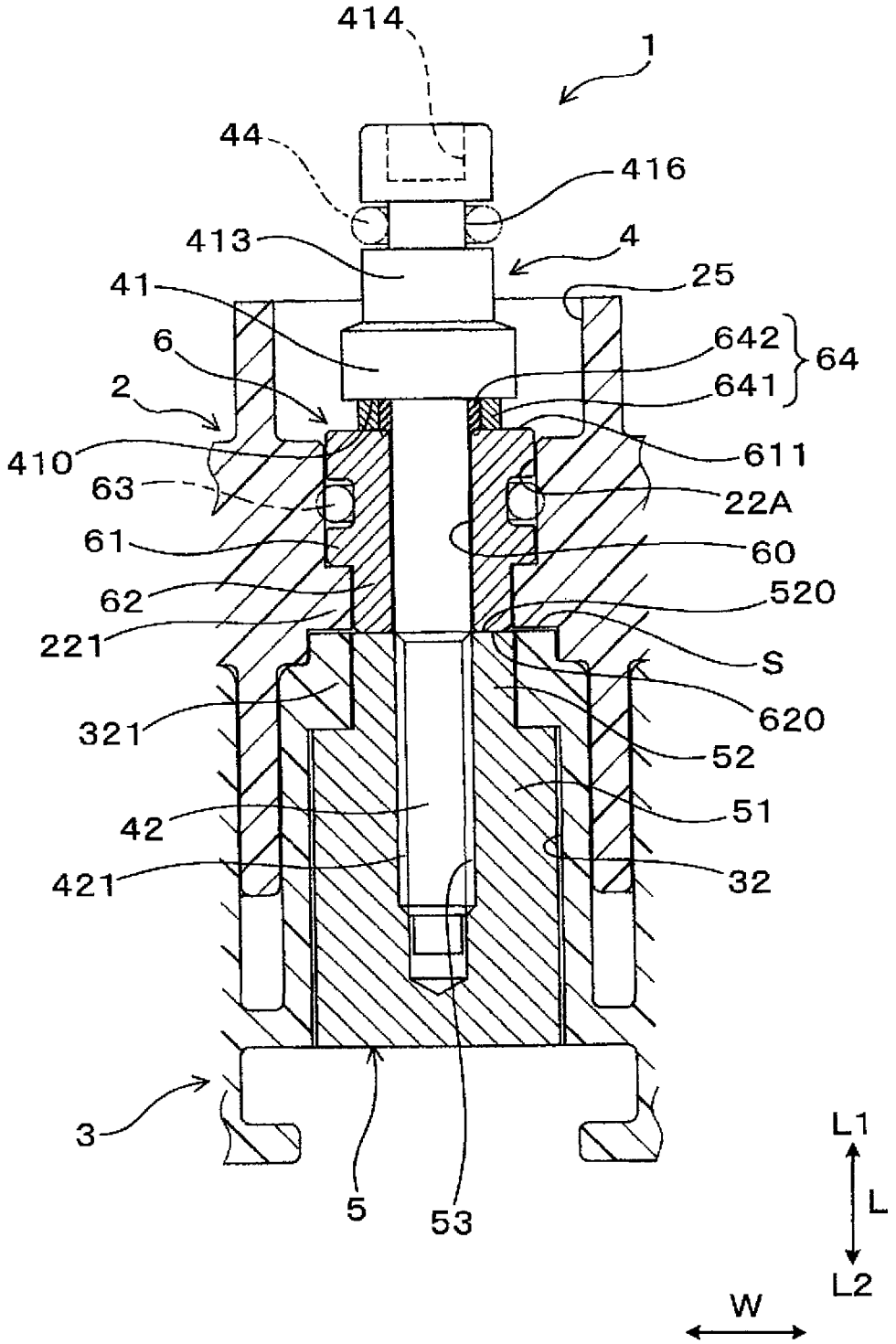
FIG. 12 is a section enlargedly showing a part of FIG. 11.
Figure 13:
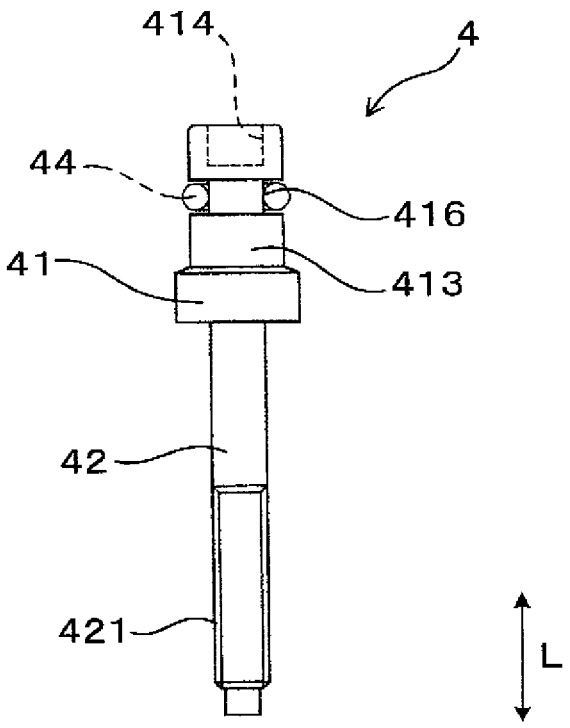
FIG. 13 is a view showing a bolt according to the second embodiment.

As shown in FIGS. 12 and 13, the shaft 42 of the bolt 4 of this embodiment is coaxially connected to a head 41, inserted into a bolt insertion hole 22A provided in a first housing 2 and threadably engaged with the nut 5. The bolt insertion hole 22A penetrates through a facing plate 23 of the first housing 2. The head 41 of the bolt 4 is arranged in a head portion recess 25 communicating with an air side L1 of the bolt insertion hole 22A. An external thread 421 is formed on a part to be engaged threadedly with the nut 5 on a tip side of the shaft 42 of the bolt 4, but the external thread 421 is not formed on a base end side of the shaft 42.

The collar 6 is made of metal, faces the nut 5 and is arranged between the outer periphery of the shaft 42 and the inner periphery of the bolt insertion hole 22A. The collar 6 includes a large-diameter portion 61 serving as a first step for pressing the first housing 2 toward a second housing 3. The nut 5 includes a general portion 51 serving as a second step for pressing the second housing 3 toward the first housing 2. A center hole 60 into which the shaft 42 of the bolt 4 is inserted is formed in a central part of the collar 6.

The collar 6 includes a small-diameter portion 62 formed on an end part on the side of the second housing 3 (oil side L2) and the large-diameter portion 61 serving as the first step, larger in diameter than the small-diameter portion 62 and formed adjacent to the small-diameter portion 62 on the side of the first housing 2 (air side L1). A first projecting portion 221 to be pressed toward the second housing 3 by the large-diameter portion 61 is formed in the bolt insertion hole 22A. The first projecting portion 221 is located on an outer peripheral side of the small-diameter portion 62 and projects toward an inner peripheral side of the bolt insertion hole 22A. The first projection 221 of this embodiment is formed by narrowing a part in an axial direction L of the bolt insertion hole 22A. Further, the structure of the nut 5 and the structure of a second projection 321 of a nut arrangement hole 32 are the same as in the first embodiment.

As shown in FIGS. 11 and 12, since the collar 6 is used in this embodiment, a structure is employed that seals oil passing through outer and inner peripheral sides of the collar 6. An oil-proof first sealing member 63 for sealing a clearance between the collar 6 and the bolt insertion hole 22A is mounted on the outer periphery of the collar 6. Further, an oil-proof second sealing member 64 containing a metal material for sealing a clearance between an end surface 410 of the head 41 and an end surface 611 of the collar 6 is mounted on the outer periphery of the shaft 42.

Figure 14:
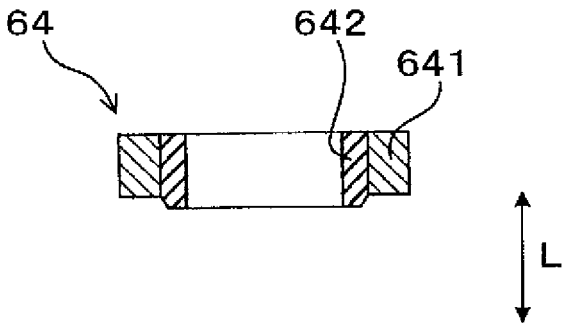
FIG. 14 is a section showing an oil-proof second sealing member according to the second embodiment.

The oil-proof first sealing member 63 is the same as in the case of the first embodiment. As shown in FIG. 14, the oil-proof second sealing member 64 includes the metal material called a sealing washer. The sealing washer includes a metal outer peripheral portion 641 made of a metal material on an outer peripheral side and a sealing inner peripheral portion 642 made of a sealing material such as rubber or resin on an inner peripheral side of the metal outer peripheral portion 641. As the sealing inner peripheral portion 642 is compressed to provide sealability, the sealing washer comes into contact with a surface of a member facing the metal outer peripheral portion 641 to be tightened.

Besides using the sealing washer, a metal gasket or the like made of a metal material and having sealability can be used as the oil-proof first sealing member 63. The oil-proof first sealing member 63 may have the part made of the metal material fastened by the bolt 4 and have a function of sealing oil or the like.

The other structures of the bolt 4 and the first housing 2, first terminals 21, second terminals 31, the second housing 3, the nut 5 and the like in the connector fitting body 1 of this embodiment are the same as in the case of the first embodiment.

(Assembling/Arranging Method of Connector Fitting Body 1)

When using the connector fitting body 1 of this embodiment as a relay connector, the oil-proof first sealing member 63 is mounted on the outer periphery of the collar 6 and this collar 6 is arranged in the bolt insertion hole 22A of the first housing 2. Further, the oil-proof second sealing member 64 is mounted on the outer periphery of the shaft 42 of the bolt 4, and the bolt 4 is inserted through the inner peripheral side of the collar 6 and fastened to the nut 5 arranged in the second housing 3.

Then, the collar 6 and the oil-proof second sealing member 64 are sandwiched between the head 41 of the bolt 4 and the nut 5. At this time, the sealing inner peripheral portion 642 of the sealing washer constituting the oil-proof second sealing member 64 is squeezed to seal the clearance between the head 41 of the bolt 4 and the collar 6 on the inner peripheral side of the collar 6. Further, the metal outer peripheral portion 641 of the sealing washer constituting the oil-proof second sealing member 64 is sandwiched between the head 41 and the collar 6. In this way, an axial force due to the tightening of the bolt 4 can be received by the nut 5 made of the metal via the metal outer peripheral portion 641 of the sealing washer and the collar 6 made of the metal materials.

(Functions and Effects)

The connector fitting body 1 of this embodiment is of such a tightening type that the first and second housings 2, 3 are fit by tightening the bolt 4 to the nut 5 via the collar 6. In this connector fitting body 1, when the bolt 4 is tightened to the nut 5 via the collar 6, the large-diameter portion (first step) 61 of the collar 6 presses the first housing 2 toward the second housing 3 and the general portion (second step) 51 of the nut 5 receives the second housing 3. In this way, the first housing 2 approaches the second housing 3. Then, as the end surface 410 of the head 41 of the bolt 4, both end surfaces of the metal outer peripheral portion 641 of the sealing washer, the end surface 620 of the collar 6 and the end surface 520 of the nut 5 come into contact, the bolt 4 is tightened to the nut 5.

The bolt 4, the metal outer peripheral portion 641 of the sealing washer, the collar 6 and the nut 5 are made of the metal, and the first and second housings 2, 3 are made of the resin to ensure insulation properties. The first and second housings 2, 3 are lower in strength than the bolt 4, the metal outer peripheral portion 641, the collar 6 and the nut 5. In the connector fitting body 1 of this embodiment, the metal materials higher in strength than the resin materials can be bonded by the successive contact of the bolt 4, the metal outer peripheral portion 641, the collar 6 and the nut 5 in the axial direction L.

By the successive contact of the bolt 4, the metal outer peripheral portion 641, the collar 6 and the nut 5 in the axial direction L, it can be suppressed that an axial force generated when the bolt 4 is tightened acts as a compression force on the first projection 221 of the first housing 2 and the second projection 321 of the second housing 3. In this way, it can be prevented that an excessive compression force acts on the first and second projections 221, 321 when the bolt 4 is tightened. Thus, the first and second projections 221, 321 can be protected from damage, and a tightening torque of the bolt 4 need not be managed strictly. Further, a large tightening torque can also be dealt with.

Further, in the connector fitting body 1 of this embodiment, when the bolt 4 is tightened, a state where the oil-proof first sealing member 63 mounted on the outer periphery of the collar 6 is in contact with the bolt insertion hole 22A of the first housing 2 is maintained and the oil-proof first sealing member 63 is managed easily.

Therefore, also in the connector fitting body 1 of this embodiment, the first and second housings 2, 3 can be protected from damage when the bolt 4 is tightened and the tightening torque of the bolt 4 can be easily managed.

Note that it is also possible not to use members for sealing the oil such as the oil-proof first sealing member 63, the oil-proof second sealing member 64, a sealing resin portion 243 and an outer peripheral sealing member 232 if the connector fitting body 1 is used in such an environment that liquid such as water or oil is not present.

Other functions, effects and the like of the connector fitting body 1 of this embodiment are the same as in the case of the first embodiment. Further, in this embodiment, constituent elements denoted by the same reference signs as those of the first embodiment are the same as in the case of the first embodiment.

The invention is not limited only to the respective embodiments and further different embodiments can be configured without departing from the scope of the invention. Further, the invention includes various modifications and modifications and the like within the scope of equivalents.

The invention claimed is:

1. A connector fitting body, comprising:

a first housing holding first terminals and having a bolt arrangement hole, a first projection projecting into the bolt arrangement hole and having opposite first and second surfaces;

a second housing holding second terminals to be brought into contact and conduction with the first terminals, the second housing being fit to the first housing and being formed with a nut arrangement hole;

a nut arranged in the nut arrangement hole in the second housing; and a bolt arranged in the bolt arrangement hole in the first housing so that the bolt is spaced from the first and second terminals, the bolt including a head and a shaft coaxially connected to the head, the shaft being engaged threadedly with the nut, wherein:

the first surface of the first projection faces away from the second housing, the head of the bolt includes a large diameter portion and a small diameter portion adjacent to the large diameter portion, a first step formed on the large diameter portion adjacent to the small diameter portion and engaging the first surface of the first projection for pressing the first housing toward the second housing, the nut includes a second step for pressing the second housing toward the second surface of the first projection of the first housing without direct contact between the second housing and the second surface of the first projection, and an axial end surface of the nut is aligned with an axial surface of the second housing facing the first housing and is in contact with an end surface of the head.

2. The connector fitting body of claim 1, wherein:

the small-diameter portion of the head is formed on an end part of the head closest to the second housing, the first projecting portion is located on an outer peripheral side of the small-diameter portion of the head of the bolt, the nut includes a general portion and a reduced portion smaller in width than the general portion and formed adjacent to the general portion on an end of the nut closest the first housing, the second step being formed on the general portion, the nut arrangement hole is formed with a second projection located on an outer peripheral side of the reduced portion of the nut, the second projection projecting toward an inner peripheral side of the nut arrangement hole and being pressed toward the first housing by the general portion, the reduced portion of the nut is radially smaller than the first projecting portion of the first housing.

3. The connector fitting body of claim 2, wherein:

the of first terminals are exposed to an air environment in which a control board is arranged, the second terminals are exposed to an oil environment, and an oil-proof sealing member for sealing a clearance between the head and the bolt arrangement hole is mounted on an outer periphery of the head.

4. A connector fitting body of claim 1, wherein:

the first terminals are conductor pins to be conductive with conductor portions provided on a control board, and a waterproof sealing member for sealing a clearance between the head and a through hole formed in a cover for covering the control board is mounted on an outer periphery of an end part of the head on a side opposite to the shaft.

5. A connector fitting body, comprising:

a first housing holding first terminals and having a bolt insertion hole, a first projection projecting into the bolt arrangement hole and having opposite first and second surfaces;

a second housing holding second terminals to be brought into contact and conduction with the first terminals, the second housing being fit to the first housing and being formed with a nut arrangement hole;

a nut arranged in the nut arrangement hole in the second housing;

a bolt arranged in the bolt arrangement hole in the first housing, the bolt including a head and a shaft coaxially connected to the head, the shaft being engaged threadedly with the nut; and a collar made of metal arranged between an outer periphery of the shaft and an inner periphery of the bolt insertion hole and between the head of the bolt and the nut, wherein:

the bolt and the collar are spaced from the first and second terminals, the first surface of the first projection faces away from the second housing, the collar includes a first step engaging the first surface of the first projection for pressing the first housing toward the second housing, the nut includes a second step for pressing the second housing toward the second surface of the first projection of the first housing, and an end surface of the nut is aligned with a surface of the second housing facing the first housing and is in contact with an end surface of the collar.

6. The connector fitting body of claim 5, wherein:

the collar includes a small-diameter portion formed on an end part of the collar closest to the second housing and a large-diameter portion adjacent the small-diameter portion and disposed farther from the second housing than the small-diameter portion, the large-diameter portion being larger in diameter than the small-diameter portion and defining the first step, the first projection is located on an outer peripheral side of the small-diameter portion of the collar, the nut includes a general portion and a reduced portion smaller in width than the general portion and formed adjacent to the general portion on an end of the nut closet the first housing, and the nut arrangement hole is formed with a second projection located on an outer peripheral side of the reduced portion of the nut, projecting toward an inner peripheral side of the nut arrangement hole and to be pressed toward the first housing by the general portion.

7. The connector fitting body of claim 6, wherein:

the first terminals are exposed to an air environment in which a control board is arranged, the second terminals are exposed to an oil environment, an oil-proof first sealing member for sealing a clearance between the collar and the bolt insertion hole is mounted on an outer periphery of the collar, and an oil-proof second sealing member containing a metal material for sealing a clearance between an end surface of the head and an end surface of the collar is mounted on the outer periphery of the shaft portion.

* * * * *